US009435140B2

(12) United States Patent
Chen

(10) Patent No.: US 9,435,140 B2
(45) Date of Patent: Sep. 6, 2016

(54) LOCKING DEVICE

(71) Applicant: Yen-Po Chen, Taipei (TW)

(72) Inventor: Yen-Po Chen, Taipei (TW)

( * ) Notice: Subject to any disclaimer, the term of this patent is extended or adjusted under 35 U.S.C. 154(b) by 56 days.

(21) Appl. No.: 14/522,672

(22) Filed: Oct. 24, 2014

(65) Prior Publication Data

US 2015/0330103 A1 Nov. 19, 2015

(30) Foreign Application Priority Data

May 15, 2014 (TW) ..... 103117129 A

(51) Int. Cl.
*E05B 27/00* (2006.01)
*E05B 19/00* (2006.01)
*E05B 35/06* (2006.01)

(52) U.S. Cl.
CPC ..... *E05B 27/0057* (2013.01); *E05B 19/0017* (2013.01); *E05B 27/00* (2013.01); *E05B 35/06* (2013.01); *Y10T 70/7531* (2015.04); *Y10T 70/7791* (2015.04)

(58) Field of Classification Search
CPC ..... E05B 29/0033; E05B 29/00; E05B 29/0053; E05B 27/0057; E05B 19/0017; E05B 19/0023; E05B 19/0029; E05B 19/0035; E05B 19/0041; E05B 19/0047; E05B 19/007; E05B 19/0076; E05B 27/00; E05B 35/06; Y10T 70/7881; Y10T 70/07; Y10T 70/7898; Y10T 70/787; Y10T 70/8595; Y10T 70/8622; Y10T 70/7531; Y10T 70/7791
USPC ..... 70/358, 375, 492, 493, 395, 401, 403, 70/404, 406, 407, 409, 412, 419
See application file for complete search history.

(56) References Cited

U.S. PATENT DOCUMENTS 424,412 A * 3/1890 Fischer ..... E05B 35/06 70/407
616,751 A * 12/1898 Vedder ..... E05B 35/06 70/407
1,932,706 A * 10/1933 Neer ..... E05B 35/06 70/372
3,780,549 A * 12/1973 Schlage ..... E05B 27/00 70/358
4,026,133 A * 5/1977 Marter ..... E05B 17/007 70/134
4,454,735 A * 6/1984 Huang ..... E05B 35/06 70/346
5,893,284 A * 4/1999 Hrabal ..... E05B 27/00 70/358
6,758,074 B1 * 7/2004 Prunbauer ..... E05B 19/0017 70/366
6,925,844 B2 * 8/2005 Liu ..... E05B 35/06 70/358
9,200,474 B1 * 12/2015 Chen ..... E05B 27/0057
2004/0172992 A1 * 9/2004 Huang ..... E05B 35/06 70/358
2005/0274162 A1 * 12/2005 Keller ..... E05B 27/005 70/358
2014/0298871 A1 * 10/2014 Shen ..... E05B 27/0075 70/493

* cited by examiner

*Primary Examiner* — Suzanne Barrett
(74) *Attorney, Agent, or Firm* — Nixon & Vanderhye P.C.

(57) ABSTRACT

A locking device includes a lock and a key. The lock includes a housing, a cylindrical core inserted into and rotatable relative to the housing, and a tumbler unit that is mounted between the housing and the cylindrical core to permit or prevent the relative rotation between the housing and the cylindrical core and that has a first pin extending into a helical keyway formed in the cylindrical core. The key has a helical blade capable of being inserted into the helical keyway to access the first pin, so as to switch the tumbler unit to permit the relative rotation between the cylindrical core and the housing.

21 Claims, 5 Drawing Sheets

LOCKING DEVICE

CROSS-REFERENCE TO RELATED APPLICATIONS

This application claims priority of Taiwanese Application No. 103117129, filed on May 15, 2014.

FIELD OF THE INVENTION

The invention relates to a locking device, more particularly to a lock and a key.

BACKGROUND OF THE INVENTION

A conventional lock includes a housing, a central cylinder and a plurality of tumbler units. The central cylinder is inserted into the housing, is rotatable relative to the housing, and has a straight keyway that is formed through an insertion end thereof. Each of the tumbler units includes first and second pins that are mounted movably between the housing and the central cylinder. The first pin extends into the keyway. The second pin abuts against one end of the first pin distal from the keyway. Each of the tumbler units is operable to switch between a locking state, where the second pin of the tumbler unit is inserted into both of the housing and the central cylinder to prevent the relative rotation between the housing and the central cylinder, and an unlocking state, where the first and second pins are retracted respectively into the central cylinder and the housing to permit the relative rotation between the housing and the central cylinder.

The first pin of each of the tumbler units can be accessed by a straight key blade that is inserted into the keyway, such that each of the tumbler units can be driven to switch to the unlocking state to permit the relative rotation between the housing and the central cylinder. However, the conventional lock is easily picked since a picking tool may be easily inserted into the straight keyway to access the first pins of the tumbler units.

SUMMARY OF THE INVENTION

Therefore, the object of the present invention is to provide a pick-resistant locking device.

Accordingly, a locking device of the present invention includes a lock and a key. The lock includes a housing, a cylindrical core and at least one holding unit. The housing has an inner surrounding surface defining an inner space. The cylindrical core extends along a core axis into the housing, is rotatable relative to the housing about the core axis, and has an insertion end retained in the inner space of the housing body. The holding unit includes a helical keyway and at least one tumbler unit. The helical keyway is formed in an outer surrounding surface of the cylindrical core, and extends through the insertion end of the cylindrical core to form an opening of the insertion end. The tumbler unit includes a limiting hole, an installation hole, a first pin, a second pin and a resilient member. The limiting hole is formed through the outer surrounding surface of the cylindrical core and a keyway-defining surface of the cylindrical core that defines the helical keyway. The installation hole is formed in the inner surrounding surface of the housing. The limiting hole is aligned with the installation hole when the cylindrical core is at a locked position. The first pin is movable along the limiting hole and the installation hole when the cylindrical core is at the locked position, and has a driven section extending into the helical keyway. The second pin abuts against one end of the first pin distal from the driven section, and is movable within and along the limiting hole and the installation hole when the cylindrical core is at the locked position. One of the first and second pins is inserted into both of the limiting hole and the installation hole to prevent the relative rotation between the cylindrical core and the housing when the tumbler unit is in a locking state. The first and second pins are retracted respectively into the limiting hole and the installation hole to permit the relative rotation between the cylindrical core and the housing when the tumbler unit is in an unlocking state. The resilient member is retained in the installation hole, and abuts against one end of the second pin distal from the first pin for biasing resiliently the second pin toward the cylindrical core. The key has a grip section for being held, and a blade section that is connected to the grip section, and that includes at least one helical blade. The helical blade is inserted into the helical keyway of the holding unit via the opening of the insertion end of the cylindrical core to access the driven section of the first pin when the cylindrical core is at the locked position, so as to switch the tumbler unit to the unlocking state to permit the relative rotation between the cylindrical core and the housing.

Another object of the present invention is to provide a pick-resistant lock.

Accordingly, a lock of the present invention includes a housing, a cylindrical core and at least one holding unit. The housing has an inner surrounding surface that defines an inner space. The cylindrical core extends along a core axis into the housing, is rotatable relative to the housing about the core axis, and has an insertion end retained in the inner space of the housing body. The holding unit includes a helical keyway and at least one tumbler unit. The helical keyway is formed in an outer surrounding surface of the cylindrical core, and extends through the insertion end of the cylindrical core to form an opening of the insertion end. The tumbler unit includes a limiting hole, an installation hole, a first pin, a second pin and a resilient member. The limiting hole is formed through the outer surrounding surface of the cylindrical core and a keyway-defining surface of the cylindrical core that defines the helical keyway. The installation hole is formed in the inner surrounding surface of the housing. The limiting hole is aligned with the installation hole when the cylindrical core is at a locked position. The first pin is movable along the limiting hole and the installation hole when the cylindrical core is at the locked position, and has a driven section extending into the helical keyway. The second pin abuts against one end of the first pin distal from the driven section, and is movable within and along the limiting hole and the installation hole when the cylindrical core is at the locked position. One of the first and second pins is inserted into both of the limiting hole and the installation hole to prevent the relative rotation between the cylindrical core and the housing when the tumbler unit is in a locking state. The first and second pins are retracted respectively into the limiting hole and the installation hole to permit the relative rotation between the cylindrical core and the housing when the tumbler unit is in an unlocking state. The resilient member is retained in the installation hole, and abuts against one end of the second pin distal from the first pin for biasing resiliently the second pin toward the cylindrical core. A blade member is inserted into the helical keyway of the holding unit via the opening of the insertion end of the cylindrical core to access the driven section of the first pin when the cylindrical core is at the locked position, so as to switch the tumbler unit to the unlocking state to permit the relative rotation between the cylindrical core and the housing.

Yet another object of the present invention is to provide a key for use with a pick-resistant lock.

Accordingly, a key of the present invention is adapted for use with a lock. The lock includes a housing, a cylindrical core that extends rotatably into the housing and that has a helical keyway, and a first pin that is mounted movably between the housing and the cylindrical core. The first pin has a driven section that extends into the helical keyway, and is operable between a locking state where the relative rotation between the housing and the cylindrical core is prevented, and an unlocking state where the relative rotation between the housing and the cylindrical core is permitted. The key has a grip section for being held, and a blade section connected to the grip section, and including at least one helical blade. The helical blade is adapted to be inserted into the helical keyway of the cylindrical core to access the driven section of the first pin, so as to switch the first pin to the unlocking state to permit the relative rotation between the housing and the cylindrical core.

BRIEF DESCRIPTION OF THE DRAWINGS

Other features and advantages of the present invention will become apparent in the following detailed description of the embodiment with reference to the accompanying drawings, of which.

DETAILED DESCRIPTION OF THE EMBODIMENT

Figure 1:
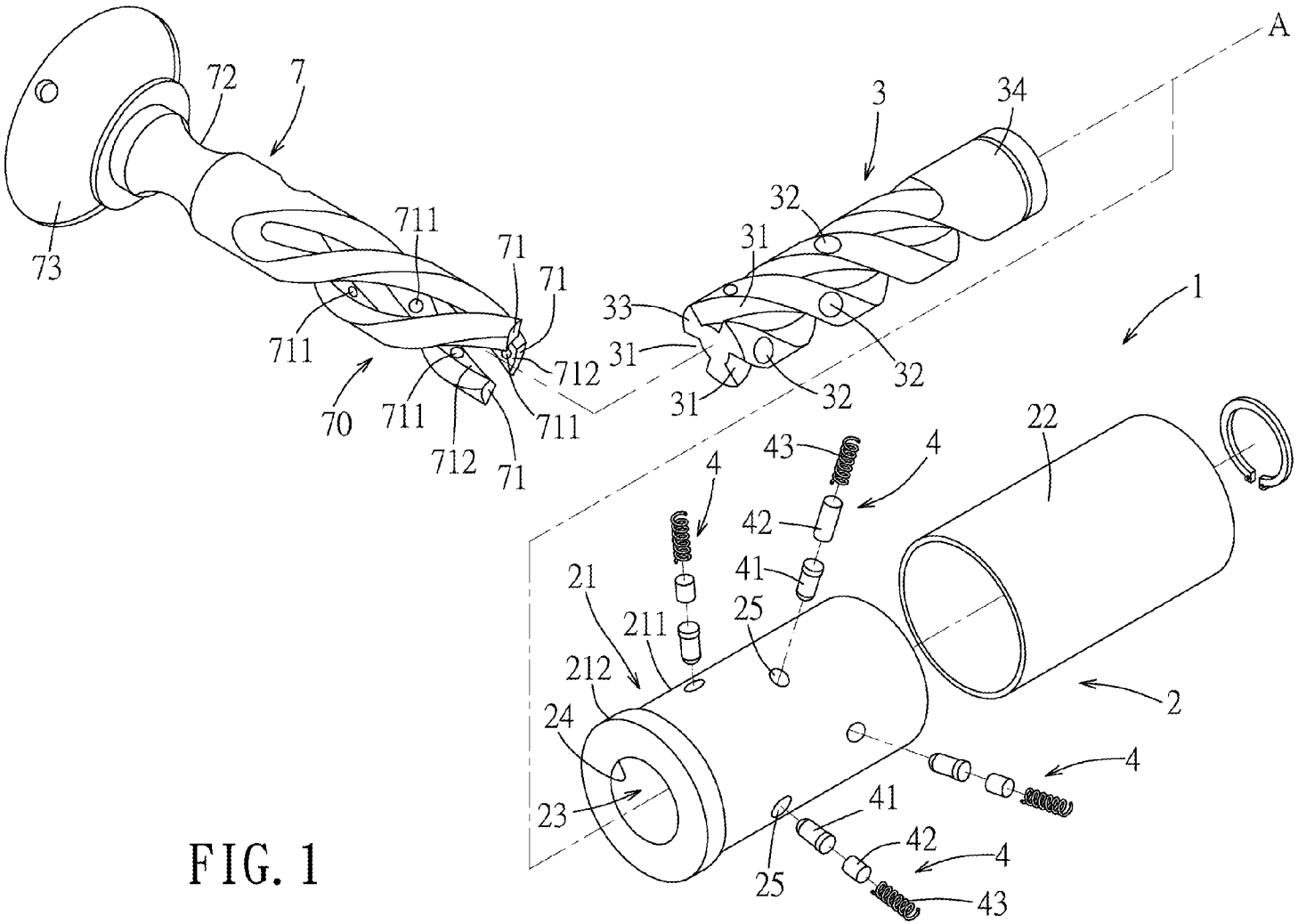
FIG. 1 is an exploded perspective view of an embodiment of a locking device according to the invention.

As shown in FIG. 1, an embodiment of a locking device according to the present invention includes a lock 1 and a key 7.

Figure 2:
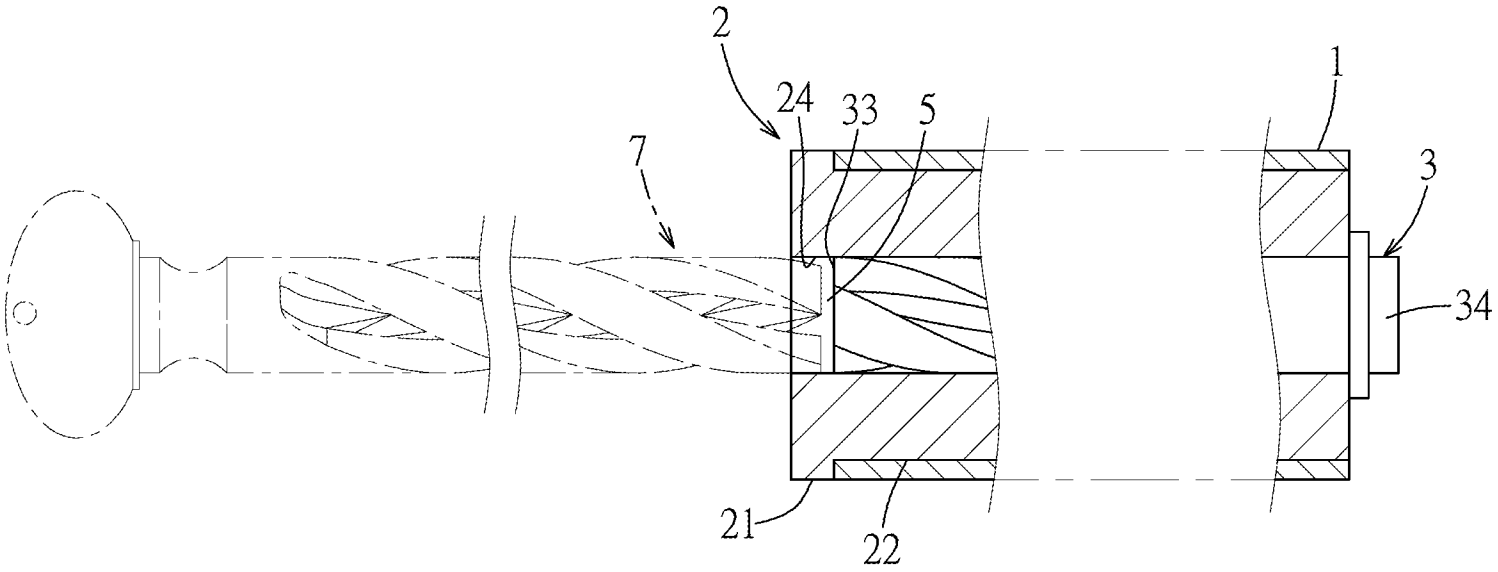
FIG. 2 is a fragmentary sectional view of a lock of the embodiment.

Referring further to FIG. 2, the lock 1 includes a housing 2, a cylindrical core 3 and three holding units. The housing 2 includes a housing body 21 and a housing sleeve 22. The housing body 21 has a tubular body 211 that has an inner surrounding surface 24 defining an inner space 23, and a flange portion 212 that is formed at one end of the tubular body 211. The housing sleeve 22 is sleeved on the tubular body 211, and abuts against the flange portion 212.

The cylindrical core 3 extends along a core axis (A), and is inserted into the housing body 21 of the housing 2. The cylindrical core 3 is rotatable relative to the housing 2 about the core axis (A), and has an insertion end 33 and a mount end 34.

The insertion end 33 is retained in the housing body 21, and cooperates with the inner surrounding surface 24 to define an insertion groove 5. The mount end 34 is opposite to the insertion end 33 along the core axis (A), and is disposed outwardly of the housing 2 for being mounted with a latch piece (not shown).

Each of the holding units includes a helical keyway 31 and at least one tumbler unit 4. For simplification, one of the holding units will be described in the following.

The helical keyway 31 is formed in an outer surrounding surface of the cylindrical core 3, and extends through the insertion end 33 of the cylindrical core 3 to form an opening of the insertion end 33 (i.e., the insertion end 33 of the cylindrical core 3 is formed with three openings corresponding respectively to the helical keyways 31 of the holding units). In this embodiment, the helical keyways 31 of the holding units are angularly spaced apart from each other about the core axis (A).

The tumbler unit 4 includes a limiting hole 32, an installation hole 25, a first pin 41, a second pin 42 and a resilient member 43.

Figure 3:
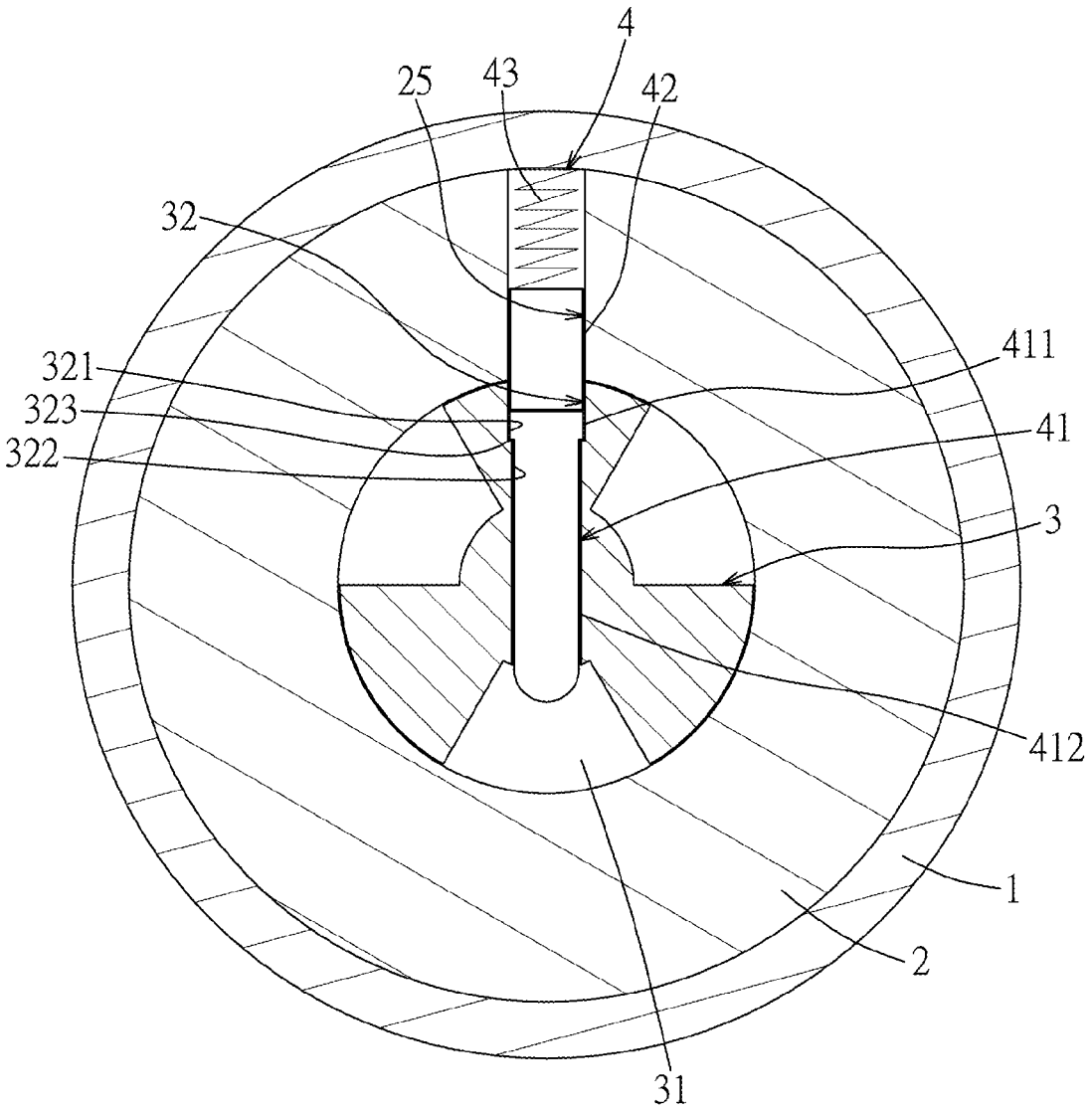
FIG. 3 is a sectional view of the lock illustrating a tumbler unit being in a locking state.
Figure 4:
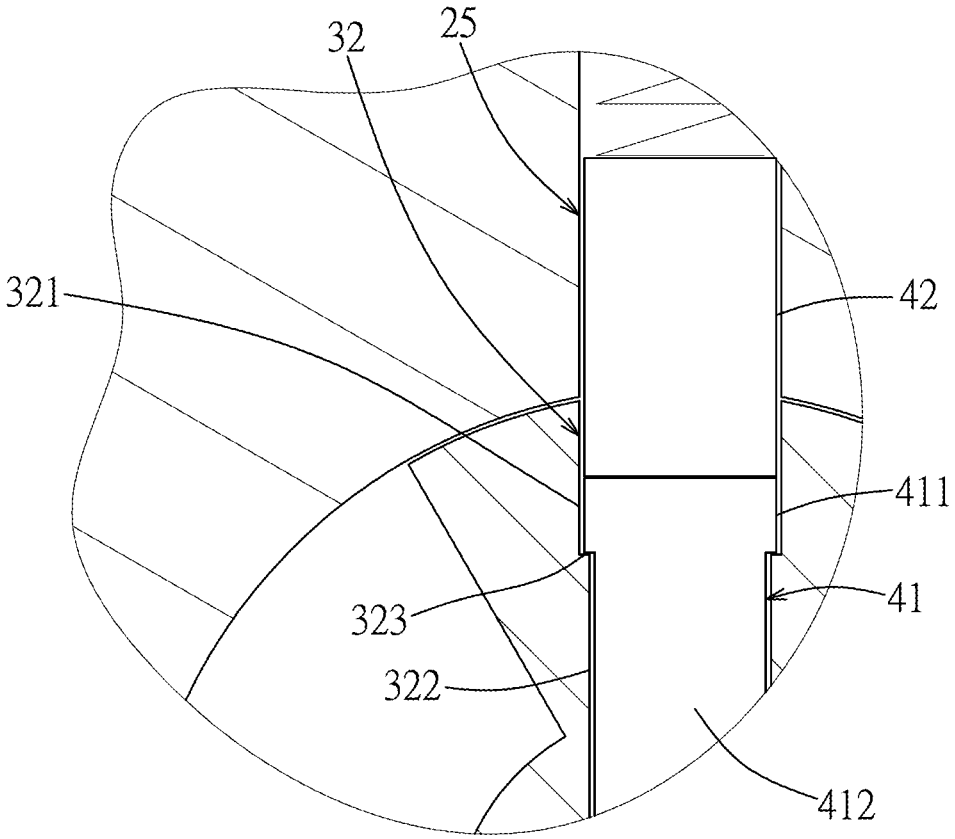
FIG. 4 is a fragmentary schematic view of the tumbler unit illustrating the configuration of a first pin and a limiting hole.

Referring further to FIGS. 3 and 4, the limiting hole 32 is formed through the outer surrounding surface of the cylindrical core 3 and a keyway-defining surface of the cylindrical core 3 that defines the helical keyway 31, and extends in a radial direction of the cylindrical core 3. The limiting hole 32 has a small-diameter section 322 that is proximate to the keyway-defining surface of the cylindrical core 3, a large-diameter section 321 that is proximate to the outer surrounding surface of the cylindrical core 3, and that has a diameter larger than that of the small-diameter section 322, and a shoulder surface 323 that is formed between the large-diameter section 321 and the small-diameter section 322.

Figure 6:
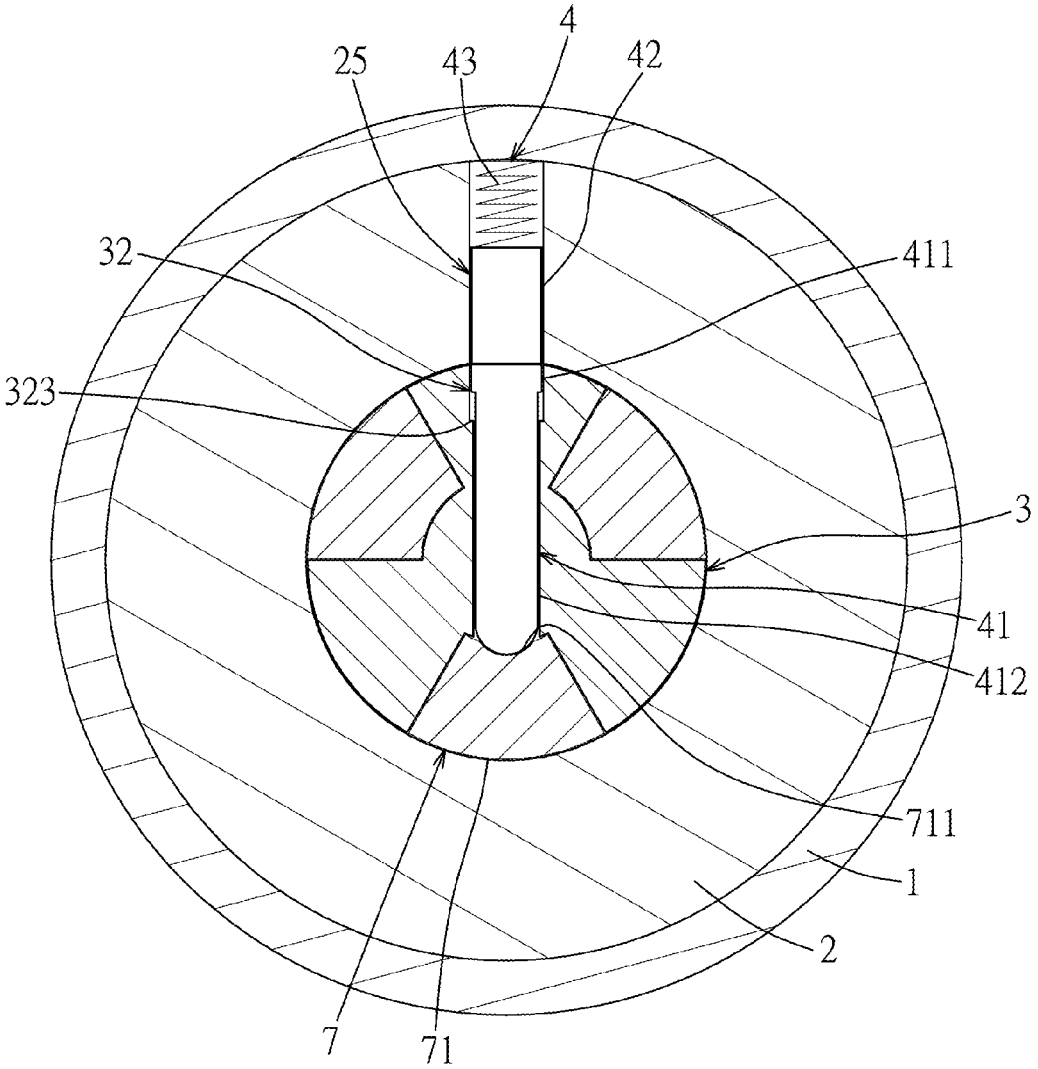
FIG. 6 is another sectional view of the lock illustrating the lock being inserted by the key and the tumbler unit being in an unlocking state.

The installation hole 25 is formed through a wall of the tubular body 211 of the housing 2, and has a diameter equal to that of the large-diameter section 321 of the limiting hole 32. The limiting hole 32 is aligned with the installation hole 25 when the cylindrical core 3 is at a locked position relative to the housing 2 (see FIGS. 3 and 6).

The first pin 41 is movable along the limiting hole 32 and the installation hole 25 when the cylindrical core 3 is at the locked position, and has a retaining section 411 and a driven section 412. The retaining section 411 is substantially retained in the large-diameter section 321 of the limiting hole 32, and has a diameter equal approximately to that of the large-diameter section 321, so as to be prevented from entering the small-diameter section 322 by the shoulder surface 323. The driven section 412 is connected to the retaining section 411 and extends through the small-diameter section 322 into the helical keyway 31.

The second pin 42 abuts against the retaining section 411 of the first pin 41, and is movable within and along the limiting hole 32 and the installation hole 25 when the cylindrical core 3 is at the locked position. The second pin 42 has a diameter equal to that of the retaining section 411 of the first pin 41.

The tumbler unit 4 is operable to switch between a locking state (FIG. 3) and an unlocking state (FIG. 6) when the cylindrical core 3 is at the locked position. One of the first and second pins 41, 42 is inserted into both of the limiting hole 32 and the installation hole 25 to prevent the relative rotation between the cylindrical core 3 and the housing 2 when the tumbler unit 4 is in the locking state. The first and second pins 41, 42 are retracted respectively into the limiting hole 32 and the installation hole 25 to permit the relative rotation between the cylindrical core 3 and the housing 2 when the tumbler unit 4 is in the unlocking state.

The resilient member 43 is retained in the installation hole 25, and has opposite ends respectively abut against an inner surrounding surface of the housing sleeve 22 and one end of the second pin 42 distal from the first pin 41 for biasing resiliently the second pin 42 toward the cylindrical core 3, such that the second pin 42 is pushed to be inserted into both of the limiting hole 32 and the installation hole 25 to prevent the relative rotation between the cylindrical core 3 and the housing 2 when the tumbler unit 4 is in the locking state (see FIG. 3). In this embodiment, the resilient member 43 is configured as a compression spring.

The key 7 has a blade section 70, a grip section 73 for being held, and a connecting section 72 interconnecting the blade section 70 and the grip section 73.

The blade section 70 has a triple-helix structure that includes three helical blades 71 corresponding respectively to the helical keyways 31 of the holding units 4. Each of the helical blades 71 has an inner helical surface 712 that extends in an extending direction of the helical blade 71, that faces radially and inwardly, and that serves as a guide surface.

Each of the helical blades 71 is able to be inserted fittingly into the corresponding helical keyway 31 via the corresponding opening to access the driven section 412 of the first pin 41 of the corresponding holding unit.

Each of the helical blades 71 further has at least one guide hole 711 that is formed in the inner helical surface 712, and that is aligned with the limiting hole 32 of the corresponding holding unit to permit the driven section 412 of the first pin 41 of the corresponding holding unit to be inserted thereinto when the helical blades 71 of the key 7 are completely and respectively inserted into the helical keyways 31, so as to switch the tumbler units 4 of the holding units to the unlocking state to permit the relative rotation between the cylindrical core 3 and the housing 2.

Figure 5:
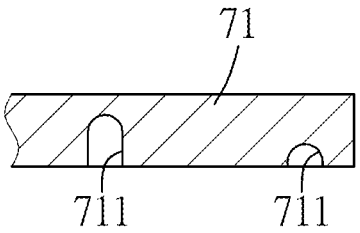
FIG. 5 is a fragmentary section view of a developed helical blade of a key of the embodiment.

In this embodiment, one of the holding units includes two tumbler units 4, and the helical blade 71 corresponding to the helical keyway 31 thereof has two guide holes 711. The guide holes 711 are aligned respectively with the limiting holes 32 of the tumbler units 4 to permit the first pins 41 of the tumbler units 4 to be respectively inserted thereinto when the corresponding helical blade 71 is completely inserted into the helical keyway 31. Referring to FIG. 5, the corresponding helical blade 71 is developed for being described clearly. The guide holes 711 of the corresponding helical blade 71 have different depths. Since the first pins 41 of the tumbler units 4 are inserted respectively into the guide holes 711, and are flush with the outer surrounding surface of the cylindrical core 3 at ends thereof abutting against the second pins 42 for permitting the relative rotation between the cylindrical core 3 and the housing 2 when the corresponding helical blade 71 is completely inserted into the helical keyway 31, the first pins 41 correspondingly have different lengths for fitting respectively within the guide holes 711.

Initially, the cylindrical core 3 is at the locked position, and each of the tumbler units 4 is in the locking state to prevent the relative rotation between the cylindrical core 3 and the housing 2. At this time, the latch piece is retained in a locking groove (not shown).

Referring to FIG. 2, to remove the latch piece from the locking groove, the blade section 70 of the key 7 is first inserted into the insertion groove 5, and is therefore limited to rotate within the insertion groove 5 until distal ends of the helical blades 71 are respectively registered with the openings of the insertion end 33 of the cylindrical core 3.

Then, the helical blades 71 are inserted respectively into the helical keyways 31 of the holding units. The tumbler units 4 of the holding units are switched to the unlocking state when the helical blades 71 are completely and respectively inserted into the helical keyways 31. As a result, the latch piece can be removed from the locking groove by rotating the grip section 73 of the key 7 to drive rotation of the cylindrical core 3 relative to the housing 2.

When the cylindrical core 3 is rotated back to the locked position, each of the tumbler units 4 of the holding units is switched to the locking state with the helical blades 71 being disengaged respectively from the helical keyways 31.

It is noted that the lock 1 may include one or more holding units. Moreover, each of the holding units may include one or more tumbler units 4 with the corresponding helical blade 71 being formed with one or more guide holes 711 that correspond respectively to the tumbler units 4.

It is further noted that each of the helical blades 71 is adjustable in geometry and shape, such as cross-sectional area, thickness, angle and extending direction, with the helical keyways 31 being correspondingly modified.

To sum up, the lock 1 of the locking device of this invention has helical keyways 31 and driven sections 412 each extending into the corresponding helical keyway 31 to be driven. Since a picking tool must be inserted into all of the helical keyways 31 to access all of the driven sections 412 of the tumbler units 4 and to switch each of the tumbler units 4 to the unlocking state, it is difficult to pick the lock 1 unless the picking tool is configured like the helical blade 71 of the key 7.

While the present invention has been described in connection with what is considered the most practical embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A locking device comprising:

a lock including a housing that has an inner surrounding surface defining an inner space, a cylindrical core that extends along a core axis into said housing, that is rotatable relative to said housing about the core axis, and that has an insertion end retained in said inner space of said housing body, and at least one holding unit that includes a helical keyway and at least one tumbler unit, said helical keyway being formed in an outer surrounding surface of said cylindrical core, and extending through said insertion end of said cylindrical core to form an opening of said insertion end, said tumbler unit including a limiting hole, an installation hole, a first pin, a second pin and a resilient member, said limiting hole being formed through said outer surrounding surface of said cylindrical core and a keyway-defining surface of said cylindrical core that defines said helical keyway, said installation hole being formed in said inner surrounding surface of said housing, said limiting hole being aligned with said installation hole when said cylindrical core is at a locked position, said first pin being movable along said limiting hole and said installation hole when said cylindrical core is at the locked position, and having a driven section extending into said helical keyway, said second pin abutting against one end of said first pin distal from said driven section, and being movable within and along said limiting hole and said installation hole when said cylindrical core is at the locked position, one of said first and second pins being inserted into both of said limiting hole and said installation hole to prevent the relative rotation between said cylindrical core and said housing when said tumbler unit is in a locking state, said first and second pins being retracted respectively into said limiting hole and said installation hole to permit the relative rotation between said cylindrical core and said housing when said tumbler unit is in an unlocking state, said resilient member being retained in said installation hole, and abutting against one end of said second pin distal from said first pin for biasing resiliently said second pin toward said cylindrical core; and a key having a grip section for being held, and a blade section that is connected to said grip section, and that includes at least one helical blade, said helical blade being inserted into said helical keyway of said holding unit via said opening of said insertion end of said cylindrical core to access said driven section of said first pin when said cylindrical core is at the locked position, so as to switch said tumbler unit to the unlocking state to permit the relative rotation between said cylindrical core and said housing.

2. The locking device as claimed in claim 1, wherein said helical blade has a helically-extending guide surface, and a guide hole that is formed in said guide surface, and that is aligned with said limiting hole to permit said driven section of said first pin to be inserted thereinto when said helical blade of said key is completely inserted into said helical keyway, so as to switch said tumbler unit to the unlocking state to permit the relative rotation between said cylindrical core and said housing.

3. The locking device as claimed in claim 2, wherein said helical blade has an inner helical surface that faces radially and inwardly, and that serves as said guide surface.

4. The locking device as claimed in claim 1, wherein:

said limiting hole of said tumbler unit has a small-diameter section that is proximate to said keyway-defining surface of said cylindrical core, a large-diameter section that is proximate to said outer surrounding surface of said cylindrical core, and that has a diameter larger than that of said small-diameter section and equal to that of said installation hole, and a shoulder surface that is formed between said large-diameter section and said small-diameter section; and said first pin further has a retaining section that is retained in said large-diameter section of said limiting hole, and that has a diameter equal approximately to that of said large-diameter section, so as to be prevented from entering said small-diameter section by said shoulder surface, said driven section being connected to said retaining section and extending through said small-diameter section into said helical keyway.

5. The locking device as claimed in claim 4, wherein said limiting hole extends in a radial direction of said cylindrical core.

6. The locking device as claimed in claim 2, wherein:

said holding unit includes two said tumbler units; and said helical blade has two said guide holes that are aligned respectively with said limiting holes of said tumbler units when said helical blade of said key is completely inserted into said keyway, said guide holes having different depths, said first pins of said tumbler units having different lengths.

7. The locking device as claimed in claim 1, wherein:

said lock includes a plurality of said holding units, said helical keyways of said holding units being angularly spaced apart from each other about the core axis; and said blade section of said key has a multiple-helix structure that includes a plurality of said helical blades for being inserted respectively into said helical keyways of said holding units.

8. The locking device as claimed in claim 1, wherein said housing includes a housing body having a tubular body that has said inner surrounding surface, and that is formed with said installation hole, and a flange portion that is formed at one end of said tubular body, and a housing sleeve sleeved on said tubular body and abutting against said flange portion.

9. The locking device as claimed in claim 1, wherein said insertion end of said cylindrical core cooperates with said inner surrounding surface of said housing to define an insertion groove permitting said blade section of said key to be inserted thereinto.

10. A lock comprising:

a housing having an inner surrounding surface that defines an inner space;

a cylindrical core extending along a core axis into said housing, rotatable relative to said housing about the core axis, and having an insertion end retained in said inner space of said housing body; and at least one holding unit including a helical keyway that is formed in an outer surrounding surface of said cylindrical core, and that extends through said insertion end of said cylindrical core to form an opening of said insertion end, and at least one tumbler unit that includes a limiting hole, an installation hole, a first pin, a second pin and a resilient member, said limiting hole being formed through said outer surrounding surface of said cylindrical core and a keyway-defining surface of said cylindrical core that defines said helical keyway, said installation hole being formed in said inner surrounding surface of said housing, said limiting hole being aligned with said installation hole when said cylindrical core is at a locked position, said first pin being movable along said limiting hole and said installation hole when said cylindrical core is at the locked position, and having a driven section extending into said helical keyway, said second pin abutting against one end of said first pin distal from said driven section, and being movable within and along said limiting hole and said installation hole when said cylindrical core is at the locked position, one of said first and second pins being inserted into both of said limiting hole and said installation hole to prevent the relative rotation between said cylindrical core and said housing when said tumbler unit is in a locking state, said first and second pins being retracted respectively into said limiting hole and said installation hole to permit the relative rotation between said cylindrical core and said housing when said tumbler unit is in an unlocking state, said resilient member being retained in said installation hole, and abutting against one end of said second pin distal from said first pin for biasing resiliently said second pin toward said cylindrical core;

wherein a blade can be inserted into said helical keyway of said holding unit via said opening of said insertion end of said cylindrical core to access said driven section of said first pin when said cylindrical core is at the locked position, so as to switch said tumbler unit to the unlocking state to permit the relative rotation between said cylindrical core and said housing.

11. The lock as claimed in claim 10 adapted for use with a key, the key having a helical blade that has a helically-extending guide surface and a guide hole formed in the guide surface, wherein, said driven section of said first pin is adapted to be inserted into the guide hole when the helical blade is completely inserted into said helical keyway, so as to switch said tumbler unit to the unlocking state to permit the relative rotation between said cylindrical core and said housing.

12. The lock as claimed in claim 10, wherein:

said limiting hole of said tumbler unit has a small-diameter section that is proximate to said keyway-defining surface of said cylindrical core, a large-diameter section that is proximate to said outer surrounding surface of said cylindrical core, and that has a diameter larger than that of said small-diameter section and equal to that of said installation hole, and a shoulder surface that is formed between said large-diameter section and said small-diameter section; and said first pin further has a retaining section that is retained in said large-diameter section of said limiting hole, and that has a diameter equal approximately to that of said large-diameter section, so as to be prevented from entering said small-diameter section by said shoulder surface, said driven section being connected to said retaining section and extending through said small-diameter section into said helical keyway.

13. The lock as claimed in claim 12, wherein said limiting hole extends in a radial direction of said cylindrical core.

14. The lock as claimed in claim 11, the helical blade of the key having two the guide holes that have different depths, wherein said holding unit includes two said tumbler units, said first pins of said tumbler units having different lengths, said driven section of said first pin of each of said tumbler units being adapted to be inserted into a respective one of the guide holes when the helical blade is completely inserted into said keyway.

15. The lock as claimed in claim 10, comprising a plurality of said holding units, said helical keyways of said holding units being angularly spaced apart from each other about the core axis.

16. The lock as claimed in claim 10, wherein said housing includes a housing body having a tubular body that has said inner surrounding surface, and that is formed with said installation hole, and a flange portion that is formed at one end of said tubular body, and a housing sleeve sleeved on said tubular body and abutting against said flange portion.

17. The locking device as claimed in claim 10, wherein said insertion end of said cylindrical core cooperates with said inner surrounding surface of said housing to define an insertion groove adapted for permitting a key to be inserted thereinto.

18. A key adapted for use with a lock, the lock including a housing, a cylindrical core that extends rotatably into the housing and that has a helical keyway, and a first pin that is mounted movably between the housing and the cylindrical core, the first pin having a driven section that extends into the helical keyway, and being operable between a locking state where the relative rotation between the housing and the cylindrical core is prevented, and an unlocking state where the relative rotation between the housing and the cylindrical core is permitted, said key comprising:

a grip section for being held; and a blade section connected to said grip section, and including at least one helical blade, said helical blade being adapted to be inserted into the helical keyway of the cylindrical core to access the driven section of the first pin, so as to switch the first pin to the unlocking state to permit the relative rotation between the housing and the cylindrical core;

wherein said helical blade has a helically-extending guide surface, and a guide hole that is formed in said guide surface, and that is inserted by the driven section of the first pin when said helical blade is completely inserted into the helical keyway, so as to switch the first pin to the unlocking state to permit the relative rotation between the housing and the cylindrical core.

19. The key as claimed in claim 18, wherein said helical blade has an inner helical surface that faces radially and inwardly, and that serves as said guide surface.

20. The key as claimed in claim 19, the lock including two the first pins that have different lengths, wherein said helical blade has two said guide holes that are different in depth, and that respectively permit the first pins to be inserted thereinto when said helical blade is completely inserted into the keyway.

21. The key as claimed in claim 18, the cylindrical core of the lock having a plurality of the helical keyways, wherein said blade section has a multiple-helix structure that includes a plurality of said helical blades for being inserted respectively into said helical keyways.

* * * * *